US005416457A

United States Patent [19]

Nakatsuka et al.

[11] Patent Number: 5,416,457

[45] Date of Patent: May 16, 1995

[54] LATERAL ORIENTATION ANISOTROPIC MAGNET

[75] Inventors: Satoshi Nakatsuka; Akira Yasuda, both of Tokyo; Itsuo Tanaka, Chiba; Koichi Nushiro, Chiba; Takahiro Kikuchi, Chiba, all of Japan

[73] Assignee: Kawasaki Steel Corporation, Japan

[21] Appl. No.: 288,426

[22] Filed: Aug. 10, 1994

Related U.S. Application Data

[63] Continuation of Ser. No. 953,736, Sep. 29, 1992, abandoned.

[30] Foreign Application Priority Data

| | | | |
|---|---|---|---|
| Sep. 30, 1991 | [JP] | Japan | 3-251609 |
| Oct. 30, 1991 | [JP] | Japan | 3-284914 |
| Oct. 30, 1991 | [JP] | Japan | 3-284915 |
| Nov. 21, 1991 | [JP] | Japan | 3-306314 |
| Feb. 25, 1992 | [JP] | Japan | 4-038014 |

[51] Int. Cl.[6] ..... H01F 7/02; H01F 7/20; H01F 1/00; H01F 7/06

[52] U.S. Cl. ..... 335/302; 335/284; 335/285; 335/296; 29/607; 148/103; 264/DIG. 58

[58] Field of Search ..... 29/607, 608, 609, 609.1, 29/DIG. 95; 335/296, 302, 303, 304, 305, 306, 284, 285; 148/103; 264/DIG. 58; 24/303; 252/62.51

[56] References Cited

U.S. PATENT DOCUMENTS

| | | | |
|---|---|---|---|
| 1,976,230 | 10/1934 | Kato | 175/21 |
| 2,700,744 | 5/1951 | Simmons | 335/306 |
| 3,326,610 | 6/1967 | Baermann | 308/10 |
| 3,526,553 | 12/1968 | Parker | 148/103 |
| 3,550,051 | 3/1969 | Parker | 264/DIG. 58 |
| 3,898,599 | 8/1975 | Reid | 335/302 |
| 4,010,434 | 3/1977 | Kools | 335/302 |
| 4,536,230 | 8/1985 | Landa | 148/31.57 |
| 5,181,971 | 1/1993 | Ohtsuka | 148/103 |

FOREIGN PATENT DOCUMENTS

| | | | |
|---|---|---|---|
| 239370 | 4/1962 | Germany | 335/302 |
| 2231591 | 1/1974 | Germany | 335/302 |
| 2506340 | 2/1975 | Germany | 335/302 |
| 558709 | 1/1944 | United Kingdom | 335/302 |

*Primary Examiner*—Leo P. Picard
*Assistant Examiner*—Stephen T. Ryan
*Attorney, Agent, or Firm*—Austin R. Miller

[57] ABSTRACT

A lateral orientation type of anisotropic permanent magnet having a face of magnetic application and at least one lateral face adjacent to the face of magnetic application. An axis of easy magnetization of particles of a magnetic powder constituting the permanent magnet is oriented substantially along lines from the lateral face toward the face of magnetic application to increase the peak value of the surface magnetic flux density at the face of magnetic application.

10 Claims, 7 Drawing Sheets

(PRIOR ART)

LATERAL ORIENTATION ANISOTROPIC MAGNET

This application is a continuation of application Ser. No. 07/953,736 filed Sept. 29, 1992, now abandoned.

BACKGROUND OF THE INVENTION

This invention relates to an anisotropic magnet and, more particularly, to improvement of a surface magnetic field after magnetization, and further relates to a magnet capable of various uses requiring a strong surface magnetic field or a deep magnetic induction line permeation or "reach."

Magnets in accordance with the present invention can be widely used, for example, as magnets for signals, for axial gap motors, for magnetrons, for length measuring machines, for small precision motors, for fixing paper or sheets, and for health improving appliances. They can accordingly be variously shaped.

Conventionally sintered magnets such as rare earth magnets and ferrite magnets or plastic magnets have been used for such purposes. In any of these conventional magnets, magnetic powder particles are oriented in the direction of thickness as shown in FIG. 11(*a*) of the drawings. Accordingly, the magnetic characteristics of the magnet are determined by the kinds of raw material used in making it, and by the particular content of the magnetic powder.

An anisotropic magnet improved in magnetic characteristics by orienting the magnetic powder particles, is disclosed in Japanese Patent Publication No. 63-59243. In this magnet, as shown in FIG. 12(*b*) of this specification, the axes of easy magnetization of the particles are convergently oriented from the non-application faces of the magnet (all faces other than the face of application) toward the face of application of the magnet. By applying this orientation the magnetic flux density per unit area (or the magnetic fluxes per unit line) can be increased.

However, it is necessary for a ring-shaped magnet, used for example for a signal which detects magnetic fluxes with a so-called Hall device, to have a high surface magnetic field peak value. Conventional techniques have been unable to accomplish this. In the case of a magnet for use in a length measuring machine, or in a small precision motor, it is necessary to further improve the surface magnetic field of the magnet to improve its accuracy.

There is also a need to provide such improved magnets at a comparatively low price. It is further important to provide a ferrite sintered magnet or a plastic magnet having a high surface magnetic field.

OBJECTS OF THE INVENTION

It is an object of the present invention to provide an anisotropic magnet having improved surface magnetic characteristics.

Another object of the present invention is to provide a ferrite plastic magnet having a high surface magnetic field.

Still another object of the present invention is to provide a low-priced and light-weight magnet having improved surface magnetic characteristics which is easy to form and to manufacture.

SUMMARY OF THE INVENTION

We have carefully studied and observed phenomena in which magnetic powder particles are convergently oriented from non-application faces of the magnet toward the face of application of the magnet, as shown in FIG. 12(*a*) of the drawings (which orientation is hereinafter referred to as "whole-face orientation"). With such orientation the magnet has improved magnetic characteristics in comparison with conventional magnets in which the magnetic powder particles are oriented in the direction of thickness as shown in FIG. 11(*a*) of the drawings (which orientation is hereinafter referred to as "axial orientation").

In FIGS. 11(*a*) and 12(*a*), line 1 indicates a magnet and lines 2 indicate lines of magnetic induction through the magnet. We have determined that this phenomenon depends at least in part upon the number and the magnetic path length of the lines of magnetic induction that are ineffectively radiated from non-application faces of the magnet at the time of magnetic attraction.

We have conducted experiments that eliminated the radiation of a magnet face that was disposed opposite to a face of magnetic application, and wherein faces through which the magnetic flux leaked, other than the face of magnetic application were limited to lateral faces of the magnet. This reduced the number and the magnetic path length of the lines of magnetic induction that were ineffectively radiated at the time of magnetic attraction. As a result we surprisingly observed an improvement of overall magnetic characteristics that was unexpectedly high.

According to the present invention we have created a lateral-orientation type of anisotropic magnet comprising a permanent magnet having a face of magnetic application and at least one lateral face adjacent to the face of magnetic application, having an axis of easy magnetization of particles of a magnetic powder constituting the permanent magnet, wherein such axis is oriented substantially along lines of magnetic induction from the lateral face to the face of application. The shape of the magnet may be selected from various shapes including a disc-like shape, shapes of cubes and parallelepipeds, ring-like shapes, rod-like shapes having a rectangular cross section, and cylindrical shapes, for example.

These and other objects and features of the present invention will become apparent from the following description and the accompanying drawings, which illustrate particular embodiments of the invention.

BRIEF DESCRIPTION OF THE DRAWINGS

FIG. 1(*b*) is a schematic diagram of a distribution of the magnetic flux density at a surface of the magnet shown in FIG. 1(*a*);

DETAILED DESCRIPTION OF THE INVENTION

Figure 1A:
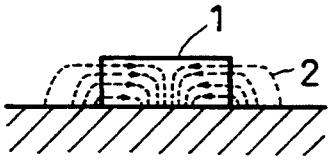
FIG. 1(*a*) is a schematic diagram of a magnetic induction line distribution of a magnet in accordance with the present invention.
Figure 1B:
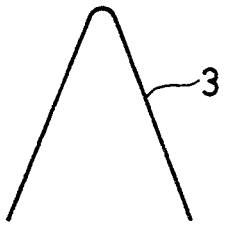
Figure 2A:
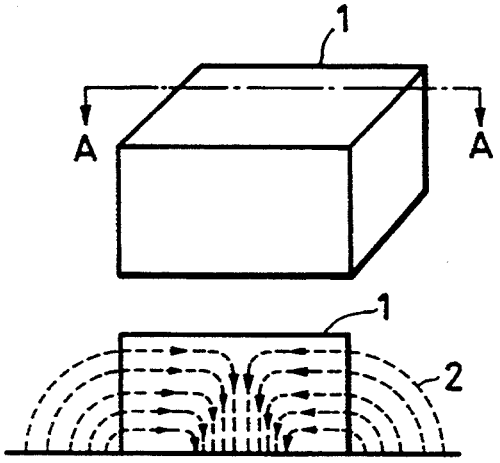
FIGS. 2(*a*) to 2(*d*) are schematic diagrams showing examples of shapes of magnets to which the present invention is applied, and showing magnetic induction line distributions in cross sections A—A of these examples.
Figure 2B:
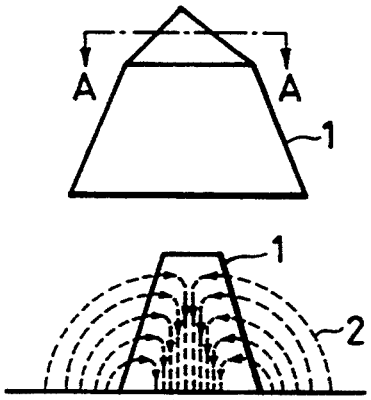
Figure 2C:
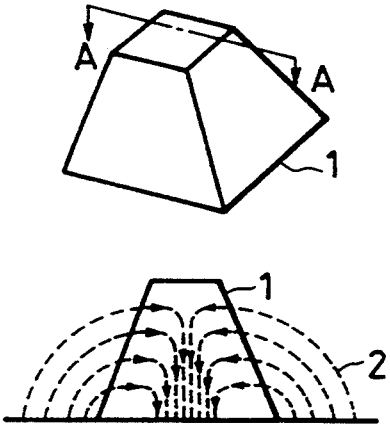
Figure 2D:
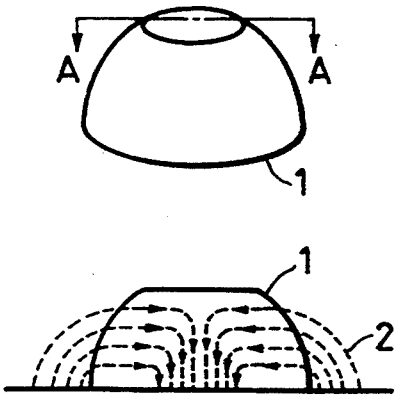

FIG. 1(*a*) shows the orientation of lines of magnetic induction of a magnet 1 in accordance with the present invention (lateral orientation type, disc-like shape type) in a magnetically attracting condition. As is apparent from FIG. 1(*a*), leaks of lines of magnetic induction from faces other than the face of magnetic application are markedly reduced in comparison with conventional axial and convergent types of magnets, so that the magnetic flux density of the magnet is remarkably increased.

Among the surface magnetic flux density patterns 3 at the face of application of the conventional axial and whole-face orientation types of magnets and the lateral orientation type of magnet of the present invention shown in FIGS. 1(*b*), 11(*b*) and 12(*b*), the surface magnetic field pattern in accordance with the present invention has a well-defined chevron-like shape 3 (FIG. 1(*b*)). The present invention therefore realizes a stronger surface magnetic flux density and a deeper magnetic induction line reach in comparison with magnets of the prior art.

The example of the magnet shown in FIG. 1(*a*) has a disc-like shape, but other shapes may be used. The magnet of the present invention may have various shapes such as those shown in FIGS. 2(*a*) to 2(*d*), i.e., rectangular parallelepiped, trapezoidal tableland-like shapes having polygonal, e.g., triangular and rectangular cross sections, and spherical tableland-like shapes, or may have shapes of a triangular prism or a cylindroid. The present invention can also be applied in the form of other magnets as described below.

Figure 3A:
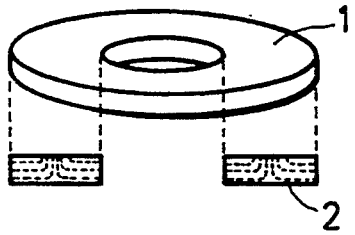
FIGS. 3(*a*) and 3(*b*) are schematic diagrams showing ring-shaped magnets to which the present invention is applied, and showing magnetic induction line distributions along cross sections of these magnets.
Figure 3B:
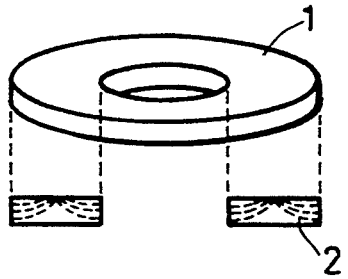

Turning now to FIGS. 3(*a*) and 3(*b*), in a magnet for a signal which operates in association with a Hall device, for example, the necessary application area or the necessary application width of the magnet with respect to the Hall device may be small in relation to the size of the Hall device if only the signal exchange with the Hall device is considered, but the peak value of the surface magnetic flux density at the effective region in the face of application must be large.

To provide a magnet used under such conditions, a lateral orientation type of ring-shaped magnet may be provided which is a ring-shaped magnet having either its obverse or reverse surface as the face of application, and in which the axes of easy magnetization of the magnetic powder of the magnet are convergently oriented from inner and outer lateral faces to a central annular region of the face of application.

In this case, magnetic induction line distributions such as those shown in sections in FIGS. 3(*a*) and 3(*b*) are obtained. Magnetic induction lines 2 shown in FIG. 3(*b*) are converged more sharply than those shown in FIG. 3(*a*).

Figure 4A:
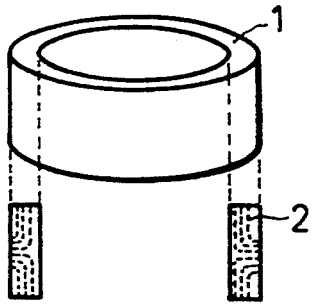
FIGS. 4(*a*) and 4(*b*) are schematic diagrams showing cylindrical magnets to which the present invention is applied, and showing magnetic induction line distributions along cross sections of these magnets.
Figure 4B:
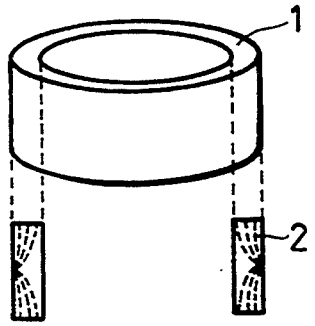

Turning now to FIGS. 4(*a*) and 4(*b*) of the drawings, a lateral orientation type of annular magnet is provided in which the axes of easy magnetization of magnetic powder are effectively oriented convergently to a central annular-band region of a circumferential face of an annular magnet so that the peak value of the surface magnetic field at this region is remarkably increased. Examples of magnetic induction line distributions of this type of magnet are illustrated in FIGS. 4(*a*) and 4(*b*).

The magnetized face of this magnet can also be utilized effectively as a magnet for producing a signal in cooperation with a Hall device.

A bar-shaped magnet is provided in which application regions are formed along a central line of an application face of the magnet extending in the longitudinal direction of the bar-shaped magnet, and in which the axes of easy magnetization of the magnetic powder particles of the magnet are oriented along lines extending to application region from two lateral regions other than the application region. This magnet is advantageously used as a magnet for a length measuring machine or as a magnet for a rotor of a small precision motor.

It is possible to increase the range of use of this magnet by forming the magnet of a flexible plastic material.

An anisotropic bar-shaped magnet is provided in FIGS. 5(*a*)–(*c*) in which application regions are formed in a plurality of regions in cross section across the longitudinal direction of the bar-shaped magnet (hereinafter referred to simply as transverse sections) and are arranged in the longitudinal direction, and in which the axes of easy magnetization of magnetic powder particles along each cross section are oriented along lines of magnetic induction extending from two lateral regions on the opposite sides of the application region to the application region.

A magnet for a signal is provided which has magnetic pole portions discontinuously formed in a face of application in the longitudinal direction from magnetic particle orientation regions sectioned correspondingly, and in which the axes of easy magnetization of magnetic powder particles in each orientation region are converged from lateral face regions of the magnetic pole portion toward the magnetic pole portion in a face of application.

Figure 5A:
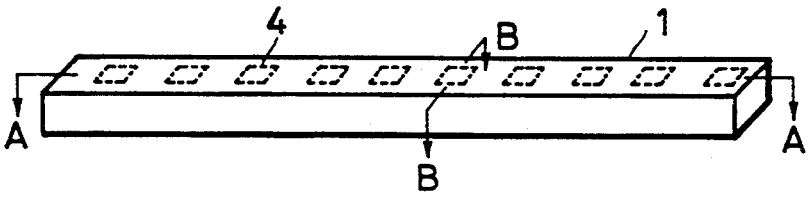
FIGS. 5(*a*) to 5(*c*) are schematic diagrams showing a rod-shaped magnet in which magnetic pole portions relating to the present invention are discontinuously formed in the face of application in the longitudinal direction, and showing magnetic induction line distributions in this magnet.
Figures 5B, 5C:
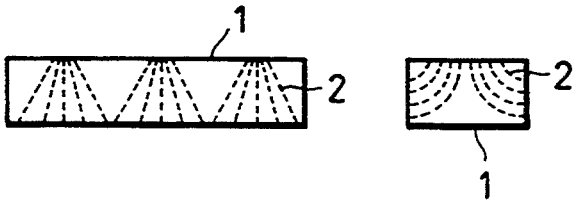

FIG. 5(*a*) shows a perspective view of a bar-shaped magnet having a magnetic powder orientation in accordance with the present invention such that a face of application is defined in its upper surface.

FIGS. 5(*b*) and 5(*c*) show conditions of orientation of magnetic powder particles of this kind of magnet in longitudinal cross section and in transverse cross section, respectively. FIG. 5(*b*) shows a simple convergent orientation while FIG. 5(*c*) shows a lateral convergent orientation.

In accordance with the present invention, as shown in FIG. 5(*a*), magnetic powder orientation regions 4 are sectioned at predetermined intervals in the longitudinal direction of the magnet, and the axes of easy magnetization of magnetic powder particles are converged (laterally converged) in each orientation region from only lateral regions toward a magnetic pole region which is set in the face of application as only a transversal-center portion having small width in the longitudinal direction.

The width and the length of a converged magnetic pole in the face of application can be suitably established according to purpose. However, to increase the peak value of the surface magnetic flux density, it is desirable that the magnetic pole width and length should be reduced.

By this arrangement, a magnet suitable for use in a length measuring machine can be obtained.

The present invention can be applied to any plastic magnets and sintered magnets.

For example, as magnetic powders for plastic magnets and sintered magnets, any well-known magnetic powders, such as ferrite, Alnico, or rare earth magnetic powders such as samarium-cobalt, and neodymium-iron-boron magnetic powders, can be used. Preferably, the average particle size may be about 1.5 μm in the case of ferrite powder and to about 5 to 50 μm in the case of other powders.

Also, any of well-known synthetic resins or natural resins can be used as the plastic for a magnet of the present invention.

Typical examples of such resins are polyamide resins, such as polyamide-6 and polyamide 12, single or copolymerized vinyl resins of polyvinyl chloride, vinyl chloride-vinyl acetate copolymer, polymethyl methacrylate, polystyrene, polyethylene, polypropylene and the like, polyurethane, silicone, polycarbonate, PBT, PET, polyether ketone, PPS, chlorinated polyethylene, Hypalon, rubbers, such as propylene, neoprene, styrene-butadiene, and acrylonitrile-butadiene rubbers, epoxy resin and phenolic resins, for example.

It is desirable that a magnetic powder and a binder synthetic resin should be blended at a ratio of 40 to 68 parts by volume of the magnetic powder and 60 to 32 parts by volume of the synthetic resin to form a raw material to be injection-molded, or at a ratio of 90 to 95 and 10 to 5 by volume to form a raw material to be compression-molded.

Needless to say, suitable amounts of commonly known plasticizers, antioxidants, surface treatment agents and so on can be included by mixing according to the intended purpose. Specifically, a plasticizer is effective in providing flexibility. Examples of such plasticizers include an ester phthalate plasticizer such as dioctyl phthalate (DOP) or dibutyl phthalate (DBP), adipic acid plasticizers such as dioctyl adipate, or high-polymer plasticizers represented by polyester, these being preferred examples.

In accordance with the present invention the direction of orientation of the magnetic powder in the magnet is controlled.

Figure 6:
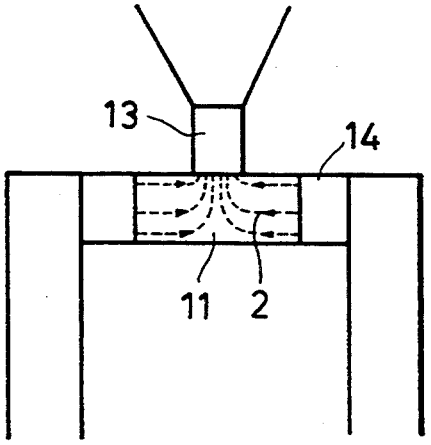
FIG. 6 is a schematic diagram of an example of an apparatus for manufacturing a magnet in accordance with the present invention.

FIG. 6 schematically shows forming dies having a suitable magnetic circuit for giving magnetic powder particle orientated in accordance with the present invention. In FIG. 6 are illustrated a cavity 11 formed inside the forming dies, a main pole 13, and an opposite pole 14.

A raw material formed by blending a magnetic powder and a resin at a predetermined ratio is introduced, for example, in an injection molding manner. While the raw material is in a softened state, a predetermined magnetic field is applied to generate lines of magnetic induction which extend along the directions of the arrows in FIG. 6, and the axes of easy magnetization of magnetic powder particles are accordingly oriented along the predetermined magnetic induction lines.

Figure 7A:
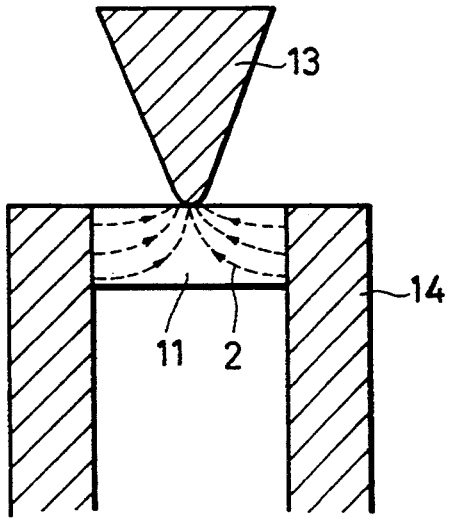
FIGS. 7(*a*) and 7(*b*) are schematic diagrams of an essential portion of other types of apparatus used to manufacture magnets in accordance with the present invention, showing a comparison between the effects of the shapes of opposite poles.
Figure 7B:
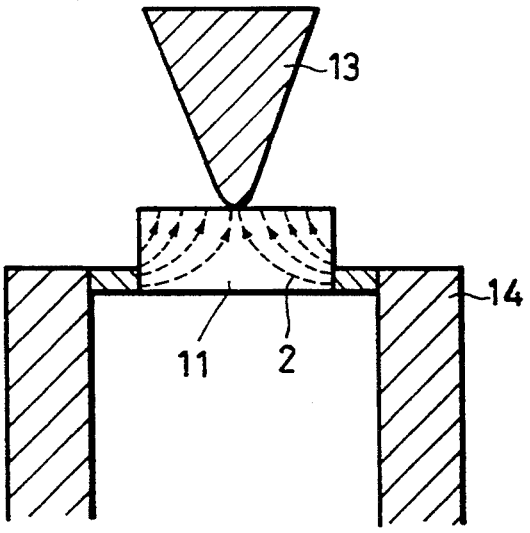

Further, in accordance with the present invention, the diameter of the opposed pole 14 may be reduced so that the magnetic powder particles are convergently oriented to a central region of the face of magnetic application, thereby constricting the magnetic flux, as shown in FIGS. 7(*a*) and 7(*b*). It is thereby possible to further increase the surface magnetic flux density per unit area in the face of magnetic application.

Figure 8:
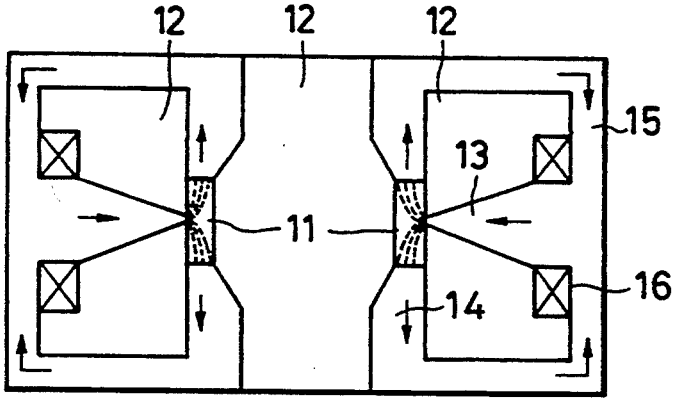
FIG. 8 is a schematic diagram of a manufacturing apparatus in the case of application of the present invention to a cylindrical magnet.

To form a cylindrical magnet it is preferable to use a magnetic field orientation type of mold as shown in FIG. 8. In FIG. 8 are illustrated a cavity 11 provided in a die 12, a main pole 13, an opposite pole 14, a yoke 15 for forming a closed magnetic path, and an excitation coil 16.

The main pole 13, the opposite pole 14 and the yoke 15 shown in FIG. 8 may be formed of a ferromagnetic material, such as carbon steel, e.g., S55C, S50C or S40C, dies steel, e.g., SKD11 or SKD61, Permendur, or pure iron. The die 12 may be formed of a non-magnetic material, such as stainless steel, copper-beryllium alloy, high manganese steel, bronze, brass, or non-magnetic super steel.

In the mold shown in FIG. 8, a raw material is introduced into the cylindrical cavity 11, for example, in an injection molding manner. While the raw material is in a softened state, a magnetic field is applied to the magnet material, and lines of magnetic induction permeate through the cylindrical cavity 11 so as to converge from two end surfaces to a central annular-band region of an outer circumferential surface on the main pole side. The axes of easy magnetization of magnetic powder particles in the raw material are thereby oriented along the lines of magnetic induction toward the central annular region of the outer circumference on the main pole side. A lateral orientation type of ring-shaped magnet such as that shown in FIG. 4(*b*) is thereby obtained.

Figure 9:
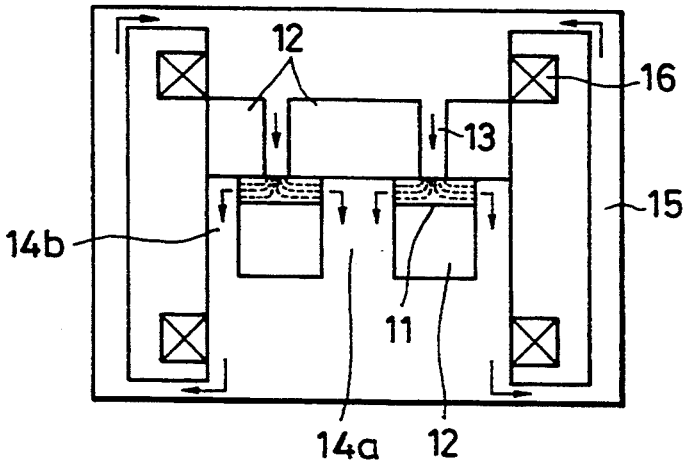
FIGS. 9 and 10 are schematic diagrams of types of manufacturing apparatus in the case of application of the present invention to a ring-shaped magnet.

FIG. 9 schematically shows a suitable example of a magnetic circuit arrangement of a magnetic field orientation forming mold for manufacturing a ring-shaped magnet such as that shown in FIG. 3(*a*). In FIG. 9 are illustrated a cavity 11 provided in a die 12, a main pole 13, an opposite pole 14 formed of an inner circumferential opposite pole **14*a* and an outer circumferential opposite pole 14*b*, a yoke 15 for forming a closed magnetic circuit, and an excitation coil 16**. The main pole, the opposite pole, and the yoke are formed of the same materials as the above-described example.

In the mold shown in FIG. 9, a raw material is introduced into the ring-shaped cavity 11, for example, in an injection molding manner. While the raw material is in a softened state, a magnetic field is applied to the magnet material, and lines of magnetic induction permeate through the ring-like cavity 11 so as to converge from outer side surfaces to a central annular region of a track on the main pole side. The axes of easy magnetization of magnetic powder particles in the magnet material are thereby oriented along the lines of magnetic induction toward the central annular region of the track on the main pole side. A lateral orientation type of ring-shaped magnet such as that shown in FIG. 3(*a*) is thereby obtained.

Figure 10:
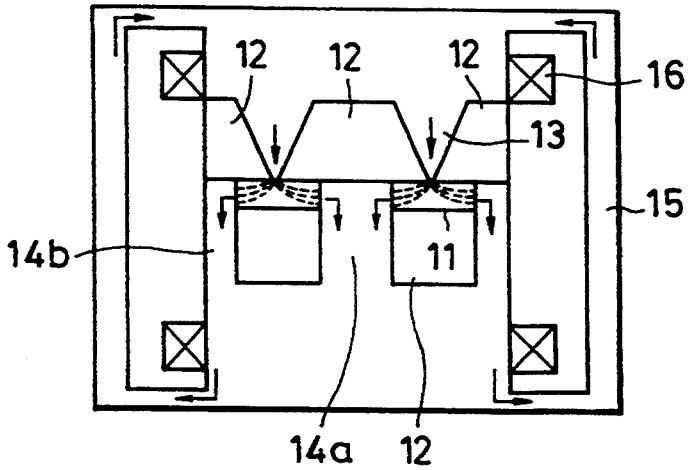

The mold magnetic circuit may be modified in such a manner that the diameter of the main magnetic pole is reduced in a tapering manner, as shown in FIG. 10, so that lines along which the magnetic powder particles are oriented are converged to a narrower central annular region of the face of application. It is thereby possible to further increase the surface magnetic flux density peak value. This arrangement is suitable for several kinds of methods of molding in a magnetic field, such as magnetic field orientation injection molding, magnetic field orientation compression molding, and magnetic field orientation RIM molding.

EXAMPLES

The following examples are intended to be illustrative, but not to limit the scope of the invention, which is defined in the appended claims.

Example 1 Disc-Shaped Magnet (1) Size and shape of magnet

The disc-shaped magnet had a diameter of 30 mm and a height of 10 mm and was formed of a plastic (P) or a sintered material (S)

(2) Raw-material (Magnetic powder)

F1: Hard ferrite powder (magneto-plumbite type strontium ferrite powder having an average particle size of 1.5 μm)

R1: Samarium-cobalt powder ($Sm_2CO_{17}$ powder having an average particle size of 10 μm)

(Plastic magnet resin)

Polyamide 12

(Plastic magnet plasticizer)

TTS (isopropyl-triisostearoyl titanate)

(3) Manufacturing process

P1: Plastic magnet

The above-mentioned plastic magnet was manufactured by mixing 64 vol. % of magnetic powder F, 35 vol. % of the resin, and 1 vol. % of the plasticizer under heating to prepare pellets and by performing injection molding using a mold having a magnetic circuit such as that shown in FIG. 6, FIG. 7 (*a*) or FIG. 7(*b*) suitable for the manufacture of the magnet of the present invention under the following conditions:

Injection cylinder temperature: 280° C.
Die temperature: 100° C.
Injection pressure: 1500 kg/cm$^2$
Excitation time: 20 sec.
Cooling time: 25 sec.
Injection cycle: 40 sec.

S1: Sintered magnet

The above-mentioned sintered magnet was manufactured by kneading 50 wt. % of magnetic powder R and 50 wt. % of water and performing compression molding using a mold having a magnetic circuit such as that shown in FIG. 7(*a*) or (*b*) and sintering under the following conditions:

Molding pressure: 500 kg/cm$^2$
Molding method: chamber type
Excitation time: 20 sec.
Molding temperature: 25° C.
Sintering temperature: 1250° C.

(4) Evaluation method (Measurement of Magnetism)

A gauss meter having a 70 μm square gallium arsenide semiconductor incorporated as a Hall device was used to measure the distribution of the surface magnetic flux density at the face of application after magnetization of the obtained disc-shaped magnet. The integrated value of the surface magnetic flux density at the face of application was thereby obtained, which is hereinafter referred to as "Linear magnetic flux number"

(Observation)

Each obtained disc-shaped magnet was cut along a plane containing a rotational symmetry axis, and the orientation of magnetic powder particles in the cut surface was observed with a scanning electron microscope (SEM).

(5) Results

Table 1 shows the peak value of the surface magnetic flux density and the linear magnetic flux number at the face of application of the obtained disc-shaped magnets after magnetization. The majority of magnetic powder particles in the cut surface of these disc-shaped magnets were oriented along lines from the lateral face to the face of application, as shown in FIG. 1(*a*).

Comparative Example 1 Disc-Shaped Magnet

Disc-shaped magnets formed of a plastic (P) or a sintered material (S) were manufactured as magnets having the same size and shape as Example 1 from the same material (magnetic powder F or R) by injection molding or by compression molding and sintering.

(1) Manufacturing process

P1: Plastic magnet

Figure 11A:
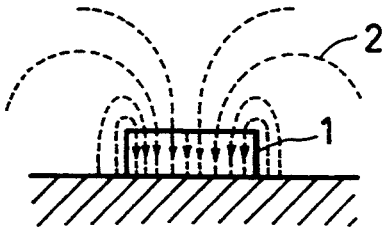
FIGS. 11(*a*) and 11(*b*) are schematic diagrams showing magnetic induction line distributions of conventional magnets and magnetic flux density distributions at surfaces of these magnets.
Figure 11B:
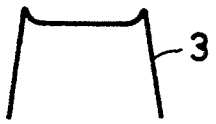
Figure 12A:
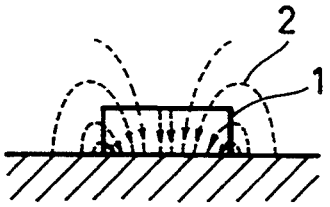
(PRIOR ART) FIG. 12(a)
FIGS. 12(*a*) and 12(*b*) are schematic diagrams showing magnetic induction line distributions of other conventional magnets and magnetic flux density distributions at surfaces of these magnets.
Figure 12B:
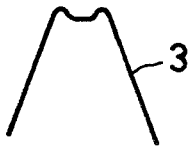

Manufactured under the same conditions as Example 1 except that molds having magnetic circuits for axial orientation shown in FIG. 11 and whole-face convergent orientation shown in FIG. 12 were used.

S1: Sintered magnet

Manufactured under the same conditions as Example 1 except that molds having magnetic circuits for axial orientation shown in FIG. 11 and whole-face convergent orientation shown in FIG. 12 were used.

(2) Results

Table 1 shows the peak value of the surface magnetic flux density and the linear magnetic flux number at the face of application of the obtained disc-shaped magnets after magnetization. The majority of magnetic powder particles in the cut surface of these disc-shaped magnets were convergently oriented as in the case of the axial orientation shown in FIG. 11 and the whole-face convergent orientation shown in FIG. 12.

As is apparent from Table 1 , the peak value of the surface magnetic flux density at the face of application of each of the lateral orientation type of disc-shaped magnets in accordance with the present invention was markedly-increased in comparison with the conventional axial orientation type and whole-face convergent orientation type disc-shaped magnets.

TABLE 1

| | Examples | | | | | Comparative Examples | | | |
|---|---|---|---|---|---|---|---|---|---|
| | 1-1 | 1-2 | 1-3 | 1-4 | 1-5 | 1-6 | 1-7 | 1-8 | 1-9 |
| Magnetic Powder | F 1 | F 1 | F 1 | R 1 | R 1 | F 1 | R 1 | F 1 | R 1 |
| Manufacturing Method | P 1 | P 1 | P 1 | S 1 | S 1 | P 1 | S 1 | P 1 | S 1 |
| Mold Magnetic Circuit | FIG. 6 | FIG. 7 (a) | FIG. 7 (b) | FIG. 7 (a) | FIG. 7 (b) | Axial Orientation | | Whole-face Convergent Orientation | |
| Surface Magnetic Flux Density Peak Value ($10^4$ T) | 980 | 1500 | 1200 | 3800 | 2900 | 500 | 1260 | 700 | 1800 |
| Linear Magnetic Flux Number (T · mm) | 2.30 | 2.50 | 2.02 | 6.20 | 4.80 | 1.15 | 2.95 | 1.31 | 3.20 |

Example 2 Cylindrical Magnet (1) Size and shape of magnet

A cylindrical magnet having an outside diameter of 60 mm, an inside diameter of 56 mm, and a height of 6 mm and formed of a plastic (P) or a sintered material (S)

(2) Raw-material

The same magnetic powder and the same plastic magnet resin as Example 1 were used except that aminosilane A-1100 was used as a plasticizer.

(3) Manufacturing process

P2: Plastic magnet

The above-mentioned plastic magnet was manufactured by mixing 64 vol. % of magnetic powder F or R,35 vol. % of the resin, and 1 vol. % of the plasticizer under heating to prepare pellets and by performing injection molding using a mold having the magnetic circuit suitable for the manufacture of the magnet of the present invention shown in FIG. 8 under the following conditions:

Injection cylinder temperature: 300° C.
Die temperature: 100° C.
Injection pressure: 1800 kg/cm$^2$
Excitation time: 15 sec.
Cooling time: 20 sec.
injection cycle: 40 sec.

S2: Sintered magnet

The above-mentioned sintered magnet was manufactured by kneading 50 wt. % of magnetic powder F or R and 50 wt. % of water and performing compression molding using a mold having a magnetic circuit such as that shown in FIG. 8 and sintering under the following conditions:

Molding pressure: 500 kg/cm
Molding method: injection type
Excitation time: 15 sec.
Molding temperature: 20° C.
Sintering temperature: 1250° C.

(4) Evaluation method (Measurement of Magnetism)

The obtained cylindrical magnets were demagnetized and then remagnetized so as to have 48 poles. The peak value of the surface magnetic flux density at the face of application thereof was measured with the same gauss meter as Example 1.

(Observation)

Each obtained cylindrical magnet was cut along a plane containing a rotational symmetry axis, and the orientation of magnetic powder particles in the cut surface was observed with a scanning electron microscope (SEM).

(5) Results

Table 2 shows the peak value of the surface magnetic flux density at the face of application of the obtained cylindrical magnets after magnetization forming 48 poles. The majority of magnetic powder particles in the cut surface of these cylindrical magnets were oriented along lines from the top and bottom faces to the face of application, as shown in FIG. 4(*a*) or 4(*b*).

Comparative Example 2: Cylindrical Magnet

Cylindrical magnets formed of a plastic (P) or a sintered material (S) were manufactured as magnets having the same size and shape as Example 2 from the same material (magnetic powder F or R) by injection molding or by compression molding and sintering.

(1) Manufacturing process

P2: Plastic magnet

Manufactured under the same conditions as Example 2 except that a mold having a magnetic circuit for radial orientation shown in FIG. 11 was used.

S2: Sintered magnet

Manufactured under the same conditions as Example 2 except that a mold having a magnetic circuit for radial orientation shown in FIG. 11 was used.

(2) Results

Table 2 shows the peak value of the surface magnetic flux density at the face of application of the obtained cylindrical magnets after magnetization forming 48 poles. The majority of magnetic powder particles in the cut surface of these cylindrical magnets were radially oriented as in the case of the radial orientation shown in FIG. 11.

As is apparent from Table 2, the peak value of the surface magnetic flux density at the face of application of each of the lateral orientation type of cylindrical magnets in accordance with the present invention is markedly increased in comparison with the conventional radial orientation type cylindrical magnet.

TABLE 2

| | Examples | | | | Comparative Examples | | | |
|---|---|---|---|---|---|---|---|---|
| | 2-1 | 2-2 | 2-3 | 2-4 | 2-5 | 2-6 | 2-7 | 2-8 |
| Magnetic Powder | F 1 | F 1 | R 1 | R 1 | F 1 | F 1 | R 1 | R 1 |
| Manufacturing Method | P 2 | S 2 | P 2 | S 2 | P 2 | S 2 | P 2 | S 2 |
| Mold Magnetic Circuit | FIG. 8 | | | | Radial Orientation | | | |
| Surface Magnetic Flux Density Peak Value ($10^4$ T) | 1150 | 1430 | 2700 | 4020 | 420 | 520 | 1010 | 1450 |

Example 3 Ring-Shaped Magnet (1) Size and shape of magnet

A ring-shaped magnet having an outside diameter of 60 mm, an inside diameter of 48 mm and a height of 2 mm and formed of a plastic (P) or a sintered material (S)

(2) Raw-material

The same magnetic powder, the same plastic magnet resin and the same plastic magnet plasticizer as those of Example 2 were used.

(3) Manufacturing process

P3: Plastic magnet

The above-mentioned plastic magnet was manufactured by mixing 64 vol. % of magnetic powder F or R, 35 vol. % of the resin, and 1 vol. % of the plasticizer under heating to prepare pellets and by performing injection molding using a mold having the magnetic circuit suitable for the manufacture of the magnet of the present invention shown in FIG. 9 or 10 under the same conditions as Example 2.

S3: Sintered magnet

The above-mentioned sintered magnet was manufactured by kneading 50 wt. % of magnetic powder F or R and 50 wt. % of water and performing compression molding using a mold having a magnetic circuit such as that shown in FIG. 9 or 10 and sintering under the same conditions as Example 2.

(4) Evaluation method (Measurement of Magnetism)

The obtained ring-shaped magnets were demagnetized and then remagnetized so as to have 48 poles. The peak value of the surface magnetic flux density at the face of application thereof (top surface of the cylinder) was measured with the same gauss meter as Example 1.

(Observation)

Each obtained ring-shaped magnet was cut along a plane containing a rotational symmetry axis, and the orientation of magnetic powder particles in the cut surface was observed with a scanning electron microscope (SEM).

(5) Results

Table 3 shows the peak value of the surface magnetic flux density at the face of application of the obtained ring-shaped magnets after magnetization forming 48 poles. The majority of magnetic powder particles in the cut surface of these ring-shaped magnets were oriented along lines from the outer and inner circumferential faces to the face of application, as shown in FIG. 3(*a*) or 3(*b*).

Comparative Example 3: Ring-Shaped Magnet

Ring-shaped magnets formed of a plastic (P) or a sintered material (S) were manufactured as magnets having the same size and shape as Example 3 from the same material (magnetic powder F or R) by injection molding or by compression molding and sintering.

(1) Manufacturing process

P3: Plastic magnet

Manufactured under the same conditions as Example 3 except that a mold having a magnetic circuit for axial orientation shown in FIG. 11 was used.

S3: Sintered magnet

Manufactured under the same conditions as Example 3 except that a mold having a magnetic circuit for axial orientation shown in FIG. 11 was used.

(2) Results

Table 3 shows the peak value of the surface magnetic flux density at the face of application of the obtained ring-shaped magnets after magnetization forming 48 poles. The majority of magnetic powder particles in the cut surface of these ring-shaped magnets were axially oriented as in the case of the axial orientation shown in FIG. 11.

As is apparent from Table 3, the peak value of the surface magnetic flux density at the face of application (top surface of the cylinder) of each of the lateral orientation type of ring-shaped magnets in accordance with the present invention was markedly increased in comparison with the conventional axial orientation type ring-shaped magnet.

TABLE 3

| | Examples | | | | | | Comparative Examples | | | |
|---|---|---|---|---|---|---|---|---|---|---|
| | 3-1 | 3-2 | 3-3 | 3-4 | 3-5 | 3-6 | 3-7 | 3-8 | 3-9 | 3-10 |
| Magnetic Powder | F 1 | F 1 | F 1 | F 1 | R 1 | R 1 | F 1 | F 1 | R 1 | R 1 |
| Manufacturing Method | P 3 | P 3 | S 3 | S 3 | P 3 | S 3 | P 3 | S 3 | P 3 | S 3 |
| Mold Magnetic Circuit | FIG. 9 | FIG. 10 | FIG. 9 | FIG. 10 | FIG. 10 | FIG. 10 | Axial Orientation | | | |
| Surface Magnetic Flux Density Peak Value ($10^4$ T) | 900 | 1250 | 1100 | 1550 | 3000 | 4400 | 450 | 560 | 1100 | 1600 |

Example 4 Rod-Shaped Magnet (1) Size and shape of magnet

A rod-shaped magnet having a width of 12 mm, a thickness of 4 mm and a length of 125 mm and formed of a plastic (P) or a sintered material (S)

(2) Raw-material (Magnetic powder)

F1: Hard ferrite powder (magneto-plumbite type strontium ferrite powder having an average particle size of 1.5 μm)

R4: Samarium-cobalt powder ($Sm_2CO_{17}$ powder having an average particle size of 15 μm)

(Plastic magnet resin)

Chlorinated polyethylene (Plastic magnet plasticizer or additive)

DOP (dioctyl phthalate)

TTS (isopropyl-triisostearoyl titanate)

(3) Manufacturing process

P4: Plastic magnet

The above-mentioned plastic magnet was manufactured by mixing 61.5 vol. % of magnetic powder F or R, 16 vol. % of the resin, 21.5 vol. % of DOP used as a plasticizer or an additive, and 0.5 vol. % of a polyethylene wax under heating to prepare pellets and by performing extrusion molding using a mold having a magnetic circuit such as that shown in FIG. 6 or FIG. 7(*a*) suitable for the manufacture of the magnet of the present invention under the following conditions:

Extruding cylinder temperature: 160° C.
Temperature in the vicinity of ejection outlet: 160° C.
Ejection rate: 2 m/min.
Extruder: Full-flight type
having a cylinder length of 70 mm, a cylinder length/inside diameter ratio of 22, and a compression ratio of 3
Excitation coil magnetomotive force: 10000 A/m
Land portion magnetic field application width: 70 mm S1: Sintered magnet The above-mentioned sintered magnet was manufactured by kneading 50 wt. % of magnetic powder F or R and 50 wt. % of water and performing compression molding using a mold having a magnetic circuit such as that shown in FIG. 8 and sintering under the following conditions:
Molding pressure: 500 kg/cm
Molding method: injection type
Excitation coil magnetomotive force: 10000 A/m
Molding temperature: 20° C.
Sintering temperature: 1250° C.

(4) Evaluation method (Measurement of Magnetism)

The peak value of the surface magnetic flux density at the face of application of each of the obtained rod-shaped magnets was measured with the same gauss meter as Example 1. The force of attracting an iron plate was also measured.

(Measurement of starting torque)

Each flexible rod-shaped plastic magnet obtained in this manner was magnetized as a magnet for a rotor disposed so as to face a stator of a flat motor, and was mounted by being wound inside a rotor yoke. The starting torque of this motor was measured.

(Observation)

Each obtained rod-shaped magnet was cut perpendicularly to the longitudinal direction thereof, and the orientation of magnetic powder particles in the cut surface was observed with a scanning electron microscope (SEM).

(5) Results

Table 4 shows the peak value of the surface magnetic flux density at the face of application of the obtained rod-shaped magnets after magnetization, the starting torque and the attraction force. The majority of magnetic powder particles in the cut surface of these rod-shaped magnets were oriented along lines from the lateral faces to the face of application, as shown in FIG. 1(*a*).

Comparative Example 4: Rod-Shaped Magnet

Rod-shaped magnets formed of a plastic (P) or a sintered material (S) were manufactured as magnets having the same size and shape as Example 4 from the same material (magnetic powder F or R) by extrusion molding or by compression molding and sintering.

(1) Manufacturing process

P4: Plastic magnet

Manufactured under the same conditions as Example 4 except that a mold having a magnetic circuit for axial orientation shown in FIG. 11 in a cross section perpendicular to the longitudinal direction was used.

S4: Sintered magnet

Manufactured under the same conditions as Example 4 except that a mold having a magnetic circuit for axial orientation shown in FIG. 11 in a cross section perpendicular to the longitudinal direction was used.

(2) Results

Table 4 shows the peak value of the surface magnetic flux density at the face of application of the obtained rod-shaped magnets after magnetization, the starting torque and the attraction force. The majority of magnetic powder particles in the cut surface of these rod-shaped magnets were axially oriented as shown in FIG. 11.

As is apparent from Table 4, the peak value of the surface magnetic flux density at the face of application of each of the lateral orientation type of rod-shaped magnets in accordance with the present invention was markedly increased in comparison with the conventional axial type or convergent orientation type rod-shaped magnets. It was also confirmed that the torque characteristic and the iron plate attracting force of the motor to which the rod-shaped magnet of the present invention was applied were improved.

As is apparent from the above-described embodiment, it is possible to greatly increase the peak value of the surface magnetic flux density at the effective region in the face of application by using the magnetic circuit arrangement of the magnetic field orientation type mold in accordance with the present invention so that magnetic powder particles in the magnet are densely converged to a certain region of the face of application.

TABLE 4

| | Examples | | | | | | | | Comparative Examples | | | |
|---|---|---|---|---|---|---|---|---|---|---|---|---|
| | 4-1 | 4-2 | 4-3 | 4-4 | 4-5 | 4-6 | 4-7 | 4-8 | 4-9 | 4-10 | 4-11 | 4-12 |
| Magnetic Powder | F 1 | R 4 | F 1 | R 4 | F 1 | R 4 | F 1 | R 4 | F 1 | R 4 | F 1 | R 4 |
| Manufactur-ing Method | P 4 | P 4 | S 4 | S 4 | P 4 | P 4 | S 4 | S 4 | P 4 | P 4 | S 4 | S 4 |
| Mold Magnetic Circuit | FIG. 6 | | | | | FIG. 7(a) | | | Axial Orientation | | | |
| Surface Magnetic Flux Density Peak Value ($10^4$ T) | 730 | 1500 | 980 | 2500 | 1400 | 2800 | 1800 | 4100 | 550 | 1150 | 750 | 2150 |
| Starting Torque(*) | 132 | 270 | — | — | — | — | — | — | 100 | 190 | — | — |
| Attraction Force(**) | 130 | 250 | 178 | 450 | — | — | — | — | 100 | 180 | 135 | 390 |

*, **: Represented by a relative value in terms of percentage to the value of Comparative Example 4-9

According to the present invention, magnetic powder particles in the material of the magnet can be effectively oriented convergently to a very narrow central annular region of the face of application, so that the peak value of the surface magnetic flux density at the effective region in the face of application of a permanent magnet after magnetization can be remarkably improved in comparison with the prior art.

Consequently, a magnetic field is produced in such a manner as to be converged more sharply, and the depth of the magnetic induction line permeation is increased, thus achieving important objects of the invention.

It will be appreciated that many modifications or variations of the invention may be practiced without departing from the spirit and scope of the invention as defined in the appended claims.

What is claimed is:

1. A lateral orientation anisotropic magnet comprising a permanent magnet composed of a magnetic powder and having a face of magnetic application and at least one lateral face adjacent to said face of magnetic application, said magnet having an axis of easy magnetization of said particles of said magnetic powder, wherein said axis is oriented substantially along lines from said lateral face to converge at said face of magnetic application such that the magnetic flux is concentrated at a central point on said face of magnetic application.

2. A lateral orientation type of anisotropic magnet according to claim 1, wherein said magnet has a disc-like shape.

3. A lateral orientation type of anisotropic magnet according to claim 1, wherein said magnet has a cylindrical shape having an outer circumferential surface and upper and lower planar surfaces.

4. A lateral orientation type of anisotropic magnet according to claim 1, wherein said magnet has a ring shape with inner and outer annular lateral faces and upper and lower planar faces.

5. The magnet of claim 4 wherein axes of easy magnetization of the magnetic powder of the magnet are convergently oriented from said inner and outer lateral faces to a central annular region on at least one of said planar faces of the face of magnet application.

6. The magnet of claim 1 wherein the peak value of the surface magnetic field of said lines of induction is at said face of magnet application.

7. A lateral orientation type of anisotropic magnet according to claim 1, wherein said magnet has a rod shape.

8. A lateral orientation type of anisotropic magnet according to claim 6, which comprises opposed surfaces each comprising a face of magnetic application.

9. A lateral orientation type of anisotropic magnet according to claim 1, wherein a plurality of magnetic application regions are discontinuously formed in the face of magnetic application.

10. The magnet of claim 3 wherein said axes of easy magnetization are convergently oriented from said upper and lower planar surfaces to a central region of said outer circumferential surface.

* * * * *

UNITED STATES PATENT AND TRADEMARK OFFICE

CERTIFICATE OF CORRECTION

PATENT NO. : 5,416,457

DATED : May 16, 1995

INVENTOR(S) : Satoshi Nakatsuka, Akira Yasuda, Itsuo Tanaka, Koichi Nushiro and Takahiro Kikuchi It is certified that error appears in the above-indentified patent and that said Letters Patent is hereby corrected as shown below:

In Column 9, line 48, please change "cm" to --$cm^2$--.

In Column 13, line 15, please change "cm" to --$cm^2$--.

Signed and Sealed this

Eleventh Day of July, 1995

*Attest:*

*Attesting Officer*

BRUCE LEHMAN

*Commissioner of Patents and Trademarks*